US008893530B2

(12) United States Patent
Nakamura et al.

(10) Patent No.: US 8,893,530 B2
(45) Date of Patent: Nov. 25, 2014

(54) WASHING MACHINE, BOOT PURIFYING AID, BOOT TRAY AND BOOT ATTACHMENT

(75) Inventors: Satoshi Nakamura, Otsu (JP); Masahiro Naito, Otsu (JP); Yasuhiro Matsusaki, Otsu (JP)

(73) Assignees: Haier Group Corporation, Shandong (CN); Qingdao Haier Washing Machine Co., Ltd., Shandong (CN)

( * ) Notice: Subject to any disclaimer, the term of this patent is extended or adjusted under 35 U.S.C. 154(b) by 1003 days.

(21) Appl. No.: 12/808,631

(22) PCT Filed: Nov. 10, 2008

(86) PCT No.: PCT/JP2008/070421

§ 371 (c)(1),
(2), (4) Date: Jun. 16, 2010

(87) PCT Pub. No.: WO2009/081666

PCT Pub. Date: Jul. 2, 2009

(65) Prior Publication Data

US 2010/0287997 A1 Nov. 18, 2010

(30) Foreign Application Priority Data

Dec. 26, 2007 (JP) ..... 2007-334933

(51) Int. Cl.

| | |
|---|---|
| ***A47L 23/20*** | (2006.01) |
| ***D06F 35/00*** | (2006.01) |
| ***D06F 58/02*** | (2006.01) |
| ***D06F 57/00*** | (2006.01) |
| ***D06F 37/08*** | (2006.01) |
| ***D06F 25/00*** | (2006.01) |

(52) U.S. Cl.

CPC ..... *A47L 23/20* (2013.01); *D06F 35/001* (2013.01); *D06F 57/00* (2013.01); *D06F 37/08* (2013.01); *D06F 25/00* (2013.01); *D06F 58/02* (2013.01)

USPC ..... 68/13 R; 68/235 R

(58) Field of Classification Search

CPC ..... A47L 23/205; A47L 23/20; D04F 58/04; D06F 59/00; D06F 35/00; D06F 58/04

USPC ..... 68/13 R, 235 R; 34/600, 104, 106

See application file for complete search history.

(56) References Cited

U.S. PATENT DOCUMENTS 3,078,526 A * 2/1963 Caruso ..... 422/186
4,136,464 A * 1/1979 Hay ..... 34/104

(Continued)

FOREIGN PATENT DOCUMENTS

CN 1589728 A 3/2005
JP 10-137007 5/1998

(Continued)

OTHER PUBLICATIONS

Machine translation of JP 2007-195896, no date.*

(Continued)

*Primary Examiner* — Joseph L Perrin

(74) *Attorney, Agent, or Firm* — Brinks Gilson & Lione

(57) ABSTRACT

It is an object of the present invention to provide a washing machine capable of advantageously sanitizing a boot with cleaning air. A tubular member (25) of a boot attachment (30) is inserted in the boot (70) with a sufficient clearance, and an upper end portion (43) of the tubular member (25) is exposed from a top (70B) of the boot (70). A second lower vent (34) provided in a lower portion of the tubular member (25) is directed to a toe portion (70C) in the boot (70), and a first intermediate vent (35) and a second intermediate vent (36) are provided in a vertically intermediate portion of the tubular member (25). Cleaning air supplied into a drum (8) of the washing machine is smoothly introduced into the tubular member (25) of the boot attachment (30) by the upper end portion (43) to flow down through the tubular member (25). The cleaning air flows out of the tubular member (25) through the first intermediate vent (35), the second intermediate vent (36) and the second lower vent (34) to spread inside the boot (70). Thus, the inside of the boot (70) is sanitized with the cleaning air.

12 Claims, 12 Drawing Sheets

(56) References Cited

U.S. PATENT DOCUMENTS

| | | | | |
|---|---|---|---|---|
| 4,200,993 | A * | 5/1980 | Blanc et al. | 34/104 |
| 5,222,308 | A * | 6/1993 | Barker et al. | 34/104 |
| 5,365,675 | A | 11/1994 | Shabram, Jr. | |
| 5,379,525 | A | 1/1995 | Raynor | |
| 6,385,862 | B1 | 5/2002 | Vande Haar | |
| 6,732,447 | B2 * | 5/2004 | Tomasi et al. | 34/90 |
| 6,845,569 | B1 * | 1/2005 | Kim | 34/106 |
| 8,087,184 | B2 * | 1/2012 | Banta et al. | 34/602 |
| 8,186,075 | B2 * | 5/2012 | Beckett | 34/106 |
| 2003/0084590 | A1 | 5/2003 | Tomasi et al. | |
| 2004/0088879 | A1 | 5/2004 | Durapau | |
| 2007/0163097 | A1 | 7/2007 | Metcalfe et al. | |
| 2008/0022551 | A1 * | 1/2008 | Banta et al. | 34/602 |
| 2009/0049874 | A1 | 2/2009 | Mamiya et al. | |
| 2009/0260404 | A1 | 10/2009 | Saito et al. | |

FOREIGN PATENT DOCUMENTS

| | | | |
|---|---|---|---|
| JP | 2004-248789 | | 9/2004 |
| JP | 2005-066070 | | 3/2005 |
| JP | 2005-152476 | | 6/2005 |
| JP | 2007-195896 | | 8/2007 |
| JP | 2007-244658 | | 9/2007 |
| JP | 2007-313006 | A | 12/2007 |

OTHER PUBLICATIONS

European Search Report issued in European Patent Application No. 08864343.2 dated Mar. 15, 2011.

International Preliminary Report on Patentability and Written Opinion of the International Searching Authority issued in International Patent Application No. PCT/JP2008/070421, mailed Jul. 8, 2010.

* cited by examiner

31

8

WASHING MACHINE, BOOT PURIFYING AID, BOOT TRAY AND BOOT ATTACHMENT

RELATED APPLICATIONS

This application is the U.S. National Phase under 35 U.S.C. §371 of International Application No. PCT/JP2008/070421, filed on Nov. 10, 2008, which in turn claims the benefit of Japanese Application No. 2007-334933, filed on Dec. 26, 2007, the disclosures of which Applications are incorporated by reference herein.

TECHNICAL FIELD

The present invention relates to a washing machine capable of sanitizing boots with cleaning air, and a boot sanitizing aid, a boot tray and a boot attachment which are used for sanitizing the boots with the cleaning air.

BACKGROUND ART

There is known a washing machine which includes a drum provided in a housing thereof and is adapted to wash laundry contained in the drum. There is also known a washing machine which is adapted to supply ozone-containing air (also called "cleaning air") into a drum thereof for sterilization and deodorization (sometimes referred to generally as "sanitization") of laundry with the cleaning air in the drum (see, for example, Patent Document 1).

The washing machine disclosed in Patent Document 1 is capable of performing a laundry sanitization operation (called "air-wash operation") with the use of the cleaning air independently of an ordinary laundry process and a drying process.

Patent Document 1: JP-A-2007-195896

DISCLOSURE OF THE INVENTION

Problems to be Solved by the Invention

In the air-wash operation, it is possible to sanitize shoes, stuffed toys and the like in addition to garments which are generally washed in the washing machine. As for the shoes, it is more convenient if not only business shoes, sandals and sneakers each having a smaller height but also boots each having a greater height can be sanitized.

In view of the foregoing, it is a principal object of the present invention to provide a washing machine which is capable of advantageously sanitizing boots with cleaning air.

It is another object of the present invention to provide a boot sanitizing aid, a boot tray and a boot attachment which are used for advantageously sanitizing boots with cleaning air.

Means for Solving the Problems

According to an inventive aspect of claim 1, there is provided a washing machine, which includes: a wash water tub; a drum provided in the wash water tub rotatably about a rotation axis extending in a horizontal direction or inclined at a predetermined angle with respect to the horizontal direction, the drum having a port provided in one of opposite end faces thereof with respect to a rotation axis extending direction, the drum being capable of containing laundry loaded therein through the port; three baffles circumferentially equidistantly provided on an inner peripheral surface of the drum for agitating the laundry in the drum; cleaning air supply means which supplies cleaning air into the drum through the port for sanitizing the laundry; a boot tray having a baffle receiving portion which receives one of the baffles located at a lowermost position, the boot tray being set in the drum so as to straddle the one baffle for receiving a pair of boots placed thereon; and a pair of boot attachments to be inserted into the respective boots; wherein the paired boot attachments each include a tubular member to be inserted into the boot with a sufficient clearance for causing the cleaning air supplied into the drum to flow down therethrough from an upper portion thereof, an introduction portion provided in the upper portion of the tubular member so as to be exposed from a boot top for introducing the cleaning air supplied to the drum into the tubular member, a lower vent provided in a lower portion of the tubular member so as to be directed toward a toe portion in the boot for causing the cleaning air to flow out of the tubular member, an intermediate vent provided in a vertically intermediate portion of the tubular member for causing the cleaning air to flow out of the tubular member, a guide portion which guides the air flowing out of the tubular member and, after sanitization of inside of the boot, causes the air to flow up through a space between the tubular member and an interior surface of the boot toward the boot top, and a unifying mechanism provided in the upper portion of the tubular member for unifying the paired boot attachments.

According to an inventive aspect of claim 2, the washing machine of claim 1 further includes control means which performs a sanitizing operation to sanitize the boots by causing the cleaning air supply means to supply the cleaning air into the drum for a predetermined period.

According to an inventive aspect of claim 3, there is provided a washing machine, which includes: a wash water tub; a drum provided in the wash water tub rotatably about a rotation axis extending in a predetermined direction for containing laundry therein; cleaning air supply means which supplies cleaning air into the drum for sanitizing the laundry; a boot tray to be set in the drum for receiving boots placed thereon; and a pair of boot attachments to be inserted into the respective boots; wherein the paired boot attachments each include a tubular member through which the cleaning air supplied into the drum flows down from an upper portion thereof, and a vent through which the cleaning air flows out of the tubular member.

According to an inventive aspect of claim 4, the vent includes a lower vent provided in a lower portion of the tubular member so as to be directed toward a toe portion in the boot in the washing machine of claim 3.

According to an inventive aspect of claim 5, the vent includes an intermediate vent provided in a vertically intermediate portion of the tubular member in the washing machine of claim 3.

According to an inventive aspect of claim 6, the intermediate vent includes a multiplicity of small holes provided in a predetermined vertical range of the tubular member in the washing machine of claim 5.

According to an inventive aspect of claim 7, the tubular member has a recess provided in an outer surface thereof as being recessed inward thereof, and the intermediate vent is provided in the recess in the washing machine of claim 6.

According to an inventive aspect of claim 8, there is provided a boot sanitizing aid to be retained in a drum of a drum type washing machine for sanitizing a boot, the boot sanitizing aid including: a boot tray to be set in the drum for receiving a boot placed thereon; and a boot attachment including a tubular member to be inserted into the boot placed on the boot tray, the tubular member having an introduction port provided at an upper end thereof for introducing cleaning air supplied to the drum into the tubular member, a lower front vent provided in a lower portion thereof for causing the cleaning air introduced into the tubular member to flow toward a toe portion in the boot, and a multiplicity of perforations provided in a side wall thereof for causing the cleaning air introduced into the tubular member to laterally flow out of the tubular member.

According to an inventive aspect of claim 9, there is provided a boot tray to be removably set in a washing machine including a rotatable drum having three baffles circumferentially equidistantly provided on an inner peripheral surface thereof for agitating laundry in the drum, and cleaning air supply means which supplies cleaning air into the drum for sanitizing the laundry, the boot tray having a baffle receiving portion which receives one of the baffles located at a lowermost position, the boot tray being set in the drum so as to straddle the one baffle for receiving a boot placed thereon.

According to an inventive aspect of claim 10, there is provided a boot attachment to be used with a boot storage apparatus including a boot container which contains a boot, and cleaning air supply means which supplies cleaning air into the boot container for sanitizing the boot, the boot attachment including a tubular member to be inserted into the boot for causing the cleaning air supplied into the boot container to flow down therethrough from an upper portion thereof, and a vent through which the cleaning air flows out of the tubular member.

According to an inventive aspect of claim 11, the boot attachment of claim 10 further includes an introduction portion provided in an upper portion of the tubular member so as to be exposed from a boot top for introducing the cleaning air supplied to the boot container into the tubular member, and a unifying mechanism provided in the upper portion of the tubular member for unifying a pair of such boot attachments, wherein the vent includes a lower vent provided in a lower portion of the tubular member so as to be directed toward a toe portion in the boot.

According to an inventive aspect of claim 12, the boot attachment of claim 10 further includes an introduction portion provided in an upper portion of the tubular member so as to be exposed from a boot top for introducing the cleaning air supplied to the boot container into the tubular member, and a unifying mechanism provided in the upper portion of the tubular member for unifying a pair of such boot attachments, wherein the vent includes an intermediate vent provided in a vertically intermediate portion of the tubular member.

Effects of the Invention

According to the inventive aspect of claim 1, the boot tray is set in the drum so as to straddle one of the three baffles located at the lowermost position in the washing machine. At this time, the boot tray is properly positioned in the drum with the one baffle received in the receiving portion thereof. Then, the boots are placed on the boot tray, and the paired boot attachments are inserted in the respective boots. The three baffles are circumferentially equidistantly provided on the inner peripheral surface of the drum. With the one baffle being located at the lowermost position, therefore, the other baffles are located away from the boots placed on the boot tray and the upper ends of the boot attachments in the drum. This prevents the other baffles from interfering with the boots and the boot attachments, thereby stabilizing the postures of the boots and the boot attachments in the drum.

The tubular member of each of the boot attachments is inserted into the boot with a sufficient clearance, and the introduction portion provided in the upper portion of the tubular member is exposed from the boot top. The lower vent provided in the lower portion of the tubular member is directed toward the toe portion in the boot, and the intermediate vent is provided in the vertically intermediate portion of the tubular member.

In the boot attachment, the cleaning air supplied into the drum by the cleaning air supply means is introduced into the tubular member by the introduction portion and then flows down through the tubular member. The cleaning air flows out of the tubular member through the intermediate vent and the lower vent to spread inside the boot. Thus, the inside of the boot is sanitized with the cleaning air.

The air flowing out of the tubular member and used for the sanitization of the inside of the boot is lighter in weight than the cleaning air (e.g., ozone), and guided by the guide portion to flow up toward the boot top through the space between the tubular member and the interior surface of the boot. Therefore, the air is smoothly expelled out of the boot. Thus, fresh cleaning air can be smoothly taken into the tubular member.

When the paired boot attachments inserted in the respective boots are unified by the unifying mechanisms provided in the upper portions of the tubular members, these boot attachments are supported by each other. This stabilizes the postures of the boot attachments during the sanitization of the insides of the boots.

As a result, the boots can be advantageously sanitized with the cleaning air in the washing machine. Particularly, the cleaning air flowing out of the tubular member through the lower vent is directed toward the toe portion in the boot, so that the toe portion can be advantageously sanitized with the cleaning air. Further, the cleaning air flowing out of the tubular member through the intermediate vent flows toward an inside portion of the boot corresponding to a portion of the tubular member ranging from the upper portion to the lower portion of the tubular member, so that the inside portion of the boot can be advantageously sanitized with the cleaning air.

According to the inventive aspect of claim 2, the control means performs the sanitizing operation to supply the cleaning air to the drum for the predetermined period. Thus, the boots can be advantageously sanitized.

According to the inventive aspect of claim 3, the boot tray is set in the drum of the washing machine, and the boots are placed on the boot tray. The paired boot attachments are inserted into the respective boots. In each of the boot attachments, the cleaning air supplied into the drum by the cleaning air supply means flows into the tubular member, and further flows down through the tubular member. The cleaning air flows out of the tubular member through the vent to spread inside the boot. Thus, the washing machine can advantageously sanitize the boots with the cleaning air.

According to the inventive aspect of claim 4, the vent includes the lower vent provided in the lower portion of the tubular member as being directed toward the toe portion in the boot. Therefore, the cleaning air flowing out of the tubular member through the lower vent flows toward the toe portion in the boot, so that the toe portion can be advantageously sanitized with the cleaning air.

According to the inventive aspect of claim 5, the vent includes the intermediate vent provided in the vertically intermediate portion of the tubular member. Therefore, the cleaning air flowing out of the tubular member through the intermediate vent flows toward the inside portion of the boot corresponding to the portion of the tubular member ranging from the upper portion to the lower portion of the tubular member, so that the inside portion can be advantageously sanitized with the cleaning air.

According to the inventive aspect of claim 6, the intermediate vent includes the multiplicity of small holes provided in the predetermined vertical range of the tubular member, so that the cleaning air can smoothly flow out of the tubular member through the small holes.

According to the inventive aspect of claim 7, the intermediate vent is provided in the recess which is provided in the outer surface of the tubular member as being recessed inward of the tubular member. Therefore, even if the interior surface of the boot is brought into contact with the outer surface of the tubular member, the intermediate vent is not closed by the interior surface of the boot. Therefore, the cleaning air can smoothly flow out of the tubular member through the intermediate vent.

According to the inventive aspect of claim 8, the boot tray of the boot sanitizing aid is set in the drum, and the boot is placed on the boot tray. The boot attachment of the boot sanitizing aid is inserted into the boot. The boot attachment includes the introduction port provided at the upper end thereof, the lower front vent provided in the lower portion thereof, and the multiplicity of perforations provided in the side wall thereof.

The cleaning air supplied into the drum is introduced into the boot attachment. The cleaning air flows toward the toe portion in the boot through the lower front vent, so that the boot toe portion can be advantageously sanitized. The cleaning air flows laterally of the boot attachment from the multiplicity of perforations. Therefore, an inside portion of the boot corresponding to a side portion of the boot attachment can be advantageously sanitized.

That is, the use of the boot sanitizing aid ensures advantageous sanitization of the boot with the cleaning air.

According to the inventive aspect of claim 9, the boot tray is set in the drum so as to straddle one of the three baffles located at the lowermost position in the washing machine. At this time, the boot tray is properly positioned in the drum with the one baffle received in the receiving portion. Then, the boot is placed on the boot tray.

The three baffles are circumferentially equidistantly provided on the inner peripheral surface of the drum. With the one baffle being located at the lowermost position, therefore, the other baffles are located away from the upper end of the boot placed on the boot tray in the drum. This prevents the other baffles from interfering with the boot, thereby stabilizing the posture of the boot in the drum.

As a result, the cleaning air can be effectively applied to the boot in the drum. With the use of the boot tray, therefore, the boot can be advantageously sanitized with the cleaning air.

According to the inventive aspect of claim 10, the boot is stored in the boot container of the boot storage apparatus, and the tubular member of the boot attachment is inserted into the boot. The cleaning air supplied into the boot container by the cleaning air supply means flows into the tubular member, and further flows down through the tubular member. Then, the cleaning air flows out of the tubular member through the vent to spread inside the boot.

With the use of the boot attachment, the boot can be advantageously sanitized with the cleaning air.

According to the inventive aspect of claim 11, the introduction portion provided in the upper portion of the tubular member of the boot attachment is exposed from the boot top. Therefore, the cleaning air supplied into the boot container by the cleaning air supply means is smoothly introduced into the tubular member by the introduction portion.

When the paired boot attachments inserted into the respective boots are unified by the unifying mechanisms provided in the upper portions of the tubular members, these boot attachments are supported by each other. This stabilizes the postures of the boot attachments during the sanitization of the insides of the boots.

Further, the vent includes the lower vent provided in the lower portion of the tubular member as being directed toward the toe portion in the boot. Therefore, the cleaning air flowing out of the tubular member through the lower vent is directed toward the toe portion in the boot, so that the toe portion can be advantageously sanitized with the cleaning air.

According to the inventive aspect of claim 12, the introduction portion provided in the upper portion of the tubular member of the boot attachment is exposed from the boot top. Therefore, the cleaning air supplied into the boot container by the cleaning air supply means is smoothly introduced into the tubular member by the introduction portion.

When the paired boot attachments inserted into the respective boots are unified by the unifying mechanisms provided in the upper portions of the tubular members, these boot attachments are supported by each other. This stabilizes the postures of the boot attachments during the sanitization of the insides of the boots.

Further, the vent includes the intermediate vent provided in the vertically intermediate portion of the tubular member. Therefore, the cleaning air flowing out of the tubular member through the intermediate vent flows toward an inside portion of the boot corresponding to a portion of the tubular member ranging from the upper portion to the lower portion of the tubular member, so that the inside portion can be advantageously sanitized with the cleaning air.

DESCRIPTION OF REFERENCE CHARACTERS

Figure 1:
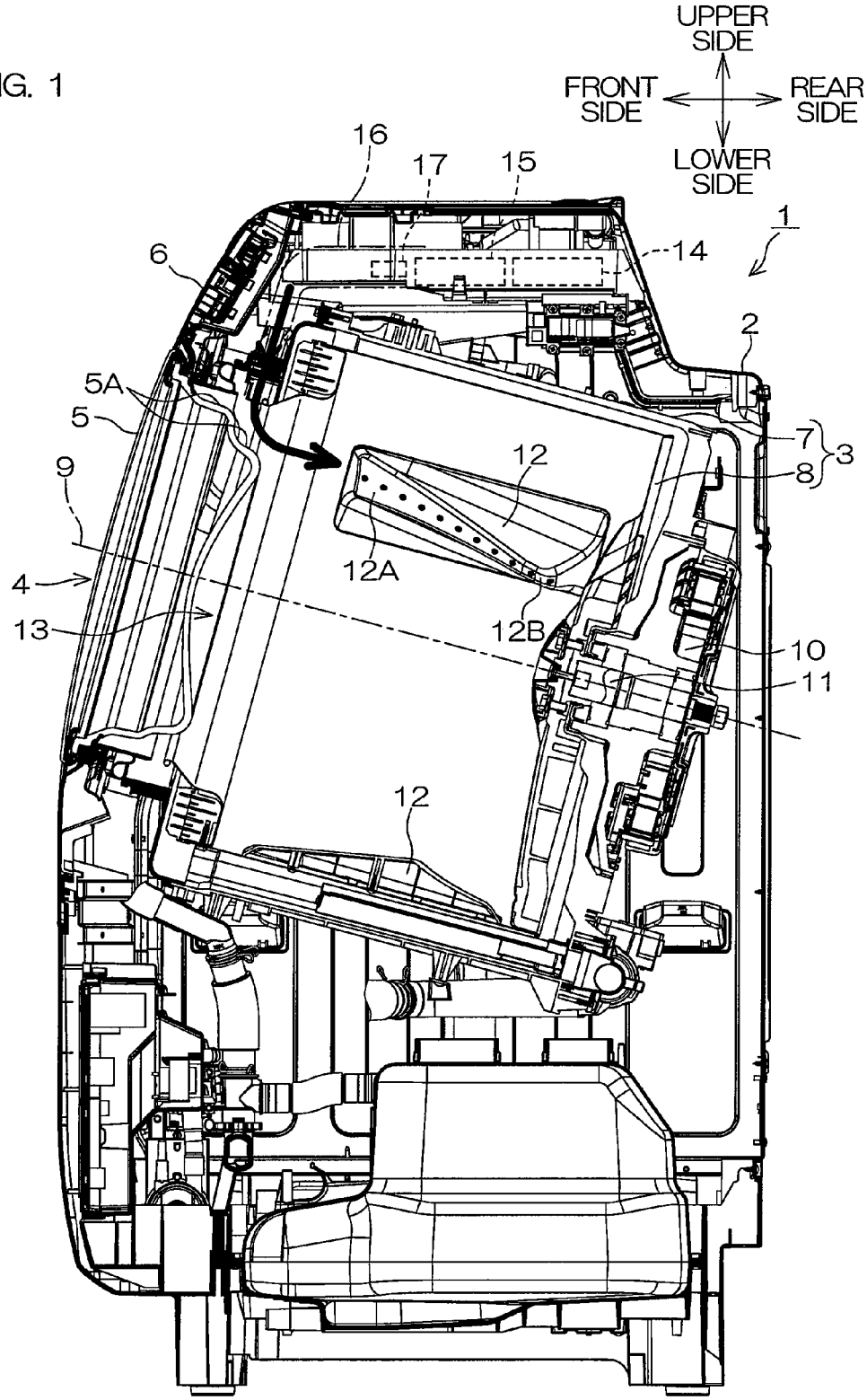
FIG. 1 is a right side sectional view of a washing machine 1 according to one embodiment of the present invention.

1: Washing machine
7: Outer tub
8: Drum
9: Rotation axis
12: Baffles
13: Port
15: Blower
16: Air flow passage
17: Ozone generator
18: Control section
25: Tubular member
25A: Outer surface
30: Boot attachments
31: Boot tray
32: Upper opening
33: First lower vent
34: Second lower vent
35: First intermediate vent
36: Second intermediate vent
37: Small holes
38: First recess
39: Second recess
43: Upper end portion
49: Magnet
60C: Recess
70: Boot
70B: Boot top
70C: Toe portion

BEST MODE FOR CARRYING OUT THE INVENTION

A washing machine 1 (boot storage apparatus) according to one embodiment of the present invention will hereinafter be described in detail with reference to the attached drawings. The present invention is also applicable to a washing/drying machine having a drying function in addition to a washing function and to a drying machine having a drying function alone.

FIG. 1 is a right side sectional view of the washing machine 1 according to the embodiment of the present invention. Reference will be made to directional arrows shown in FIG. 1 (and other figures) for directional notation. The front side and the forward side are herein defined to be equivalent to each other, and the rear side and the rearward side are herein defined to be equivalent to each other. Further, the lateral direction and the transverse direction are herein defined to be equivalent to each other.

1. Overall Construction of Washing Machine

Referring to FIG. 1, the washing machine 1 includes a housing 2 serving as an outer shell and having a generally vertically elongated cuboidal shape. A washing tub 3 which retains laundry is disposed in the housing 2. The housing 2 has a round opening 4 formed in a generally center portion of a front face (forward face) thereof, and a door 5 which can cover and uncover the opening 4 is provided on the center portion. The door 5 has a major surface, for example, formed of a transparent reinforced glass or a transparent resin, and is of a generally truncated cone shape.

An operation/indication section 6 is disposed on an upper portion of the front face of the housing 2 (above the door 5). A plurality of operation keys (not shown) and indicators (not shown) are arranged in the operation/indication section 6. The operation of the washing machine 1 is controlled by operating the operation keys (not shown), and the indicators (not shown) indicate the operation status of the washing machine 1.

The washing tub 3 includes an outer tub 7 (wash water tub) having a generally cylindrical inner peripheral surface, and a cylindrical drum 8 (boot container) provided in the outer tub 7. A rotation axis 9 defining a center axis of the drum 8 extends in a horizontal direction or in a direction inclined at a predetermined angle with respect to the horizontal direction. The drum 8 is disposed rotatably about the rotation axis 9 in the outer tub 7. Here, the rotation axis 9 extends obliquely upward toward the forward side as inclined with respect to the horizontal direction.

A DD motor 10 is attached to a rear face of the outer tub 7, and an output shaft 11 of the DD motor 10 is connected to a center of a round rear wall of the drum 8 (through which the rotation axis 9 extends). The drum 8 is rotated in the outer tub 7 by driving the DD motor 10. That is, the washing machine 1 is a drum-type washing machine.

The drum 8 has a circumferential wall formed with a multiplicity of perforations (not shown). The inside of the drum 8 and the inside of the outer tub 7 communicate with each other through the perforations.

Three baffles 12 are provided on an inner peripheral surface of the drum 8. The three baffles 12 are circumferentially equidistantly arranged on the inner peripheral surface of the drum 8. The baffles 12 are each elongated along the rotation axis 9, and project toward the rotation axis 9. Distal edges (projection edges) of the baffles 12 are each shifted circumferentially of the drum 8, and progressively approach the rotation axis 9 in a direction from the front side to the rear side. That is, the distal edges of the baffles 12 each have a front end 12A and a rear end 12B which are located at circumferentially offset positions, and the rear end 12B is the closest to the rotation axis 9.

The drum 8 has a port 13 provided in a front face thereof with respect to the extending direction of the rotation axis 9. The port 13 is opposed to the opening 4 of the housing 2. Laundry is loaded into and unloaded from the drum 8 through the opening 4 and the port 13.

The door 5 described above closes the port 13 (clogs the port 13) when closing the opening 4. As described above, the door 5 has a generally truncated cone shape and, with the opening 4 being covered with the door 5, a conical surface 5A of the door 5 is located between the opening 4 and the port 13. The conical surface 5A is not necessarily required to be a perfect conical surface, but may have a stepped intermediate portion. With the opening 4 being uncovered with the door 5, on the other hand, the port 13 is open to the front side.

The washing machine 1 performs a washing operation, a rinsing operation and a drying operation.

In the washing operation, water containing a detergent (referred to as "detergent water") is retained in the outer tub 7. The detergent water retained in the outer tub 7 reaches the drum 8, and decomposes the dirt of the laundry contained in the drum 8. In the washing operation, the drum 8 is rotated, whereby the laundry is lifted by the rotated baffles 12 and naturally dropped in the drum. Thus, a so-called beat-washing operation is performed. The baffles 12 agitate the laundry.

In the rinsing operation, water free from the detergent is applied to the laundry in the drum 8, whereby a detergent component and a dirt component are rinsed away from the laundry. Water containing a softener may be applied to the laundry after the removal of the detergent component and the dirt component. For promotion of the rinsing, the drum 8 may be rotated to agitate the laundry by the baffles 12.

For the drying operation, a heater 14 and a blower 15 are provided above the washing tub 3 in the housing 2. In the housing 2, an air flow passage 16 is provided as extending from the heater 14 and the blower 15 to a space between an upper edge of the opening 4 and an upper edge of the port 13.

In the drying operation, air heated by the heater 14 (referred to as "heated air") is blown into the air flow passage 16 by the blower 15. The heated air blown into the air flow passage 16 reaches the space between the upper edge of the opening 4 and the upper edge of the port 13 and hits against the conical surface 5A of the door 5 to be guided to the port 13 and fed into the drum 8 through the port 13 (as indicated by a bold arrow). Then, water contained in the laundry is evaporated by the heated air fed into the drum 8. Thus, the laundry is dried. For promotion of the drying, the drum 8 may be rotated to agitate the laundry by the baffles 12.

2. Ozone Supply Device

The washing machine 1 includes an ozone generator 17 provided adjacent the blower 15 (i.e., above the washing tub 3). The ozone generator 17 generates ozone during an air-wash operation (sanitizing operation) to be described later, and is contributable to sterilization and deodorization (air wash) of the laundry in the drum 8.

The air wash is herein defined as a process for sterilizing (removing bacteria from the laundry) and deodorizing the laundry with ozone by applying air containing ozone (cleaning air) to the laundry contained in the drum 8, and is different from and independent of the washing operation, the rinsing operation and the drying operation described above. The sterilization and deodorization of the laundry with the use of the ozone is referred to as "air wash" by the applicant of the present invention, because the laundry is sterilized and deodorized with the ozone-containing air as if it were washed with the air. The air-wash operation may be performed simultaneously with the drying operation.

More specifically, the blower 15 and the ozone generator 17 are actuated in the air-wash operation. The ozone generated by the ozone generator 17 is blown into the air flow passage 16 by the blower 15, and fed into the drum 8 through the air flow passage 16 and the port 13 for a predetermined period in the same manner as the heated air to be fed during the drying operation. Thus, the laundry contained in the drum 8 is sterilized and deodorized (sanitized) by the ozone-containing air. For promotion of the sanitization of the laundry, the drum 8 may be rotated to agitate the laundry by the baffles 12. The blower 15, the air flow passage 16 and the ozone generator 17 collectively function as the cleaning air supply means.

Figure 2:
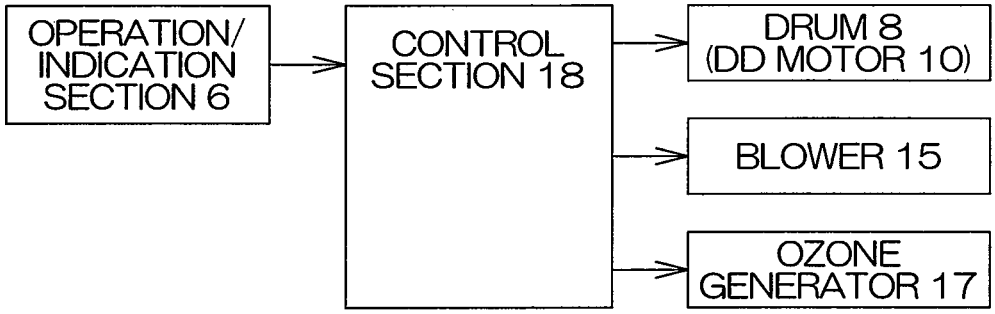
FIG. 2 is a block diagram showing an electrical configuration for air-wash operation control.

FIG. 2 is a block diagram showing an electrical configuration for air-wash operation control.

Referring to FIG. 2, the blower 15 and the ozone generator 17 are controlled by a control section 18 (control means) provided in the housing 2 in the air-wash operation. The control section 18 is electrically connected to the operation/indication section 6, the drum 8 (DD motor 10), the blower 15 and the ozone generator 17.

When the user operates the operation keys (not shown) in the operation/indication section 6 to perform the air-wash operation, the control section 18 actuates the blower 15 and the ozone generator 17 according to the operation of the operation keys to perform the air-wash operation. As required, the control section 18 rotates the drum 8 (drives the DD motor 10).

3. Boot Attachments and Boot Tray

Figure 3:
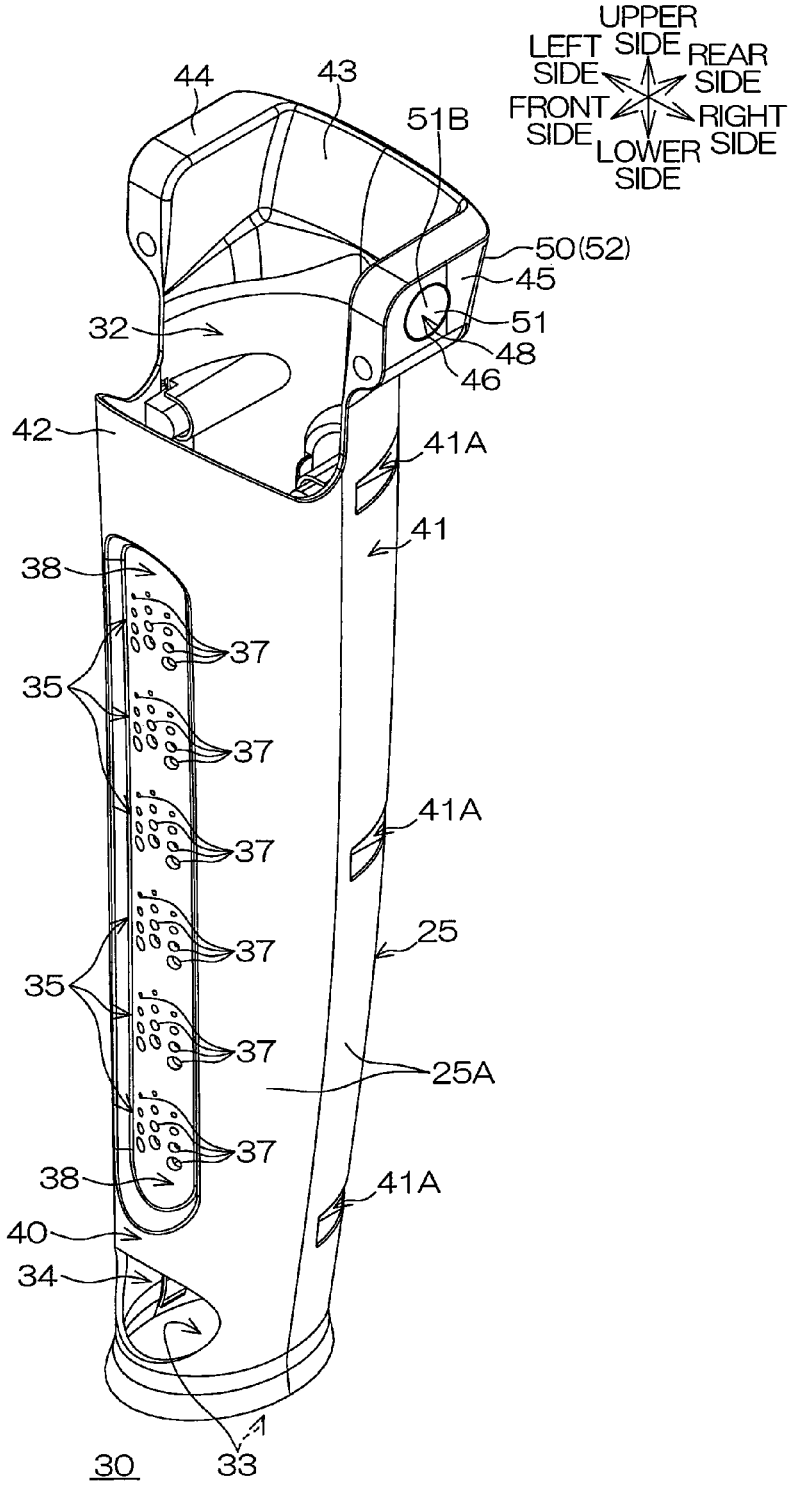
FIG. 3 is a perspective view of a boot attachment 30 as seen from the front right upper side.
Figure 4:
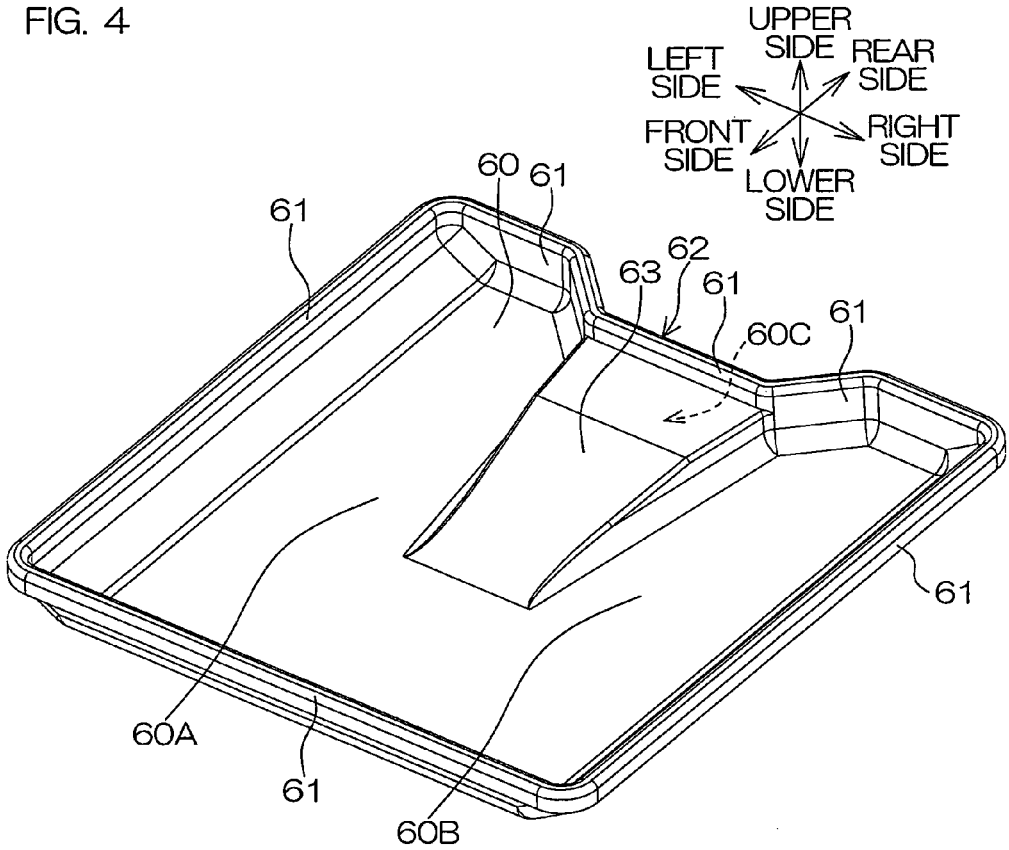
FIG. 4 is a perspective view of a boot tray 31 as seen from the front right upper side.
Figure 5:
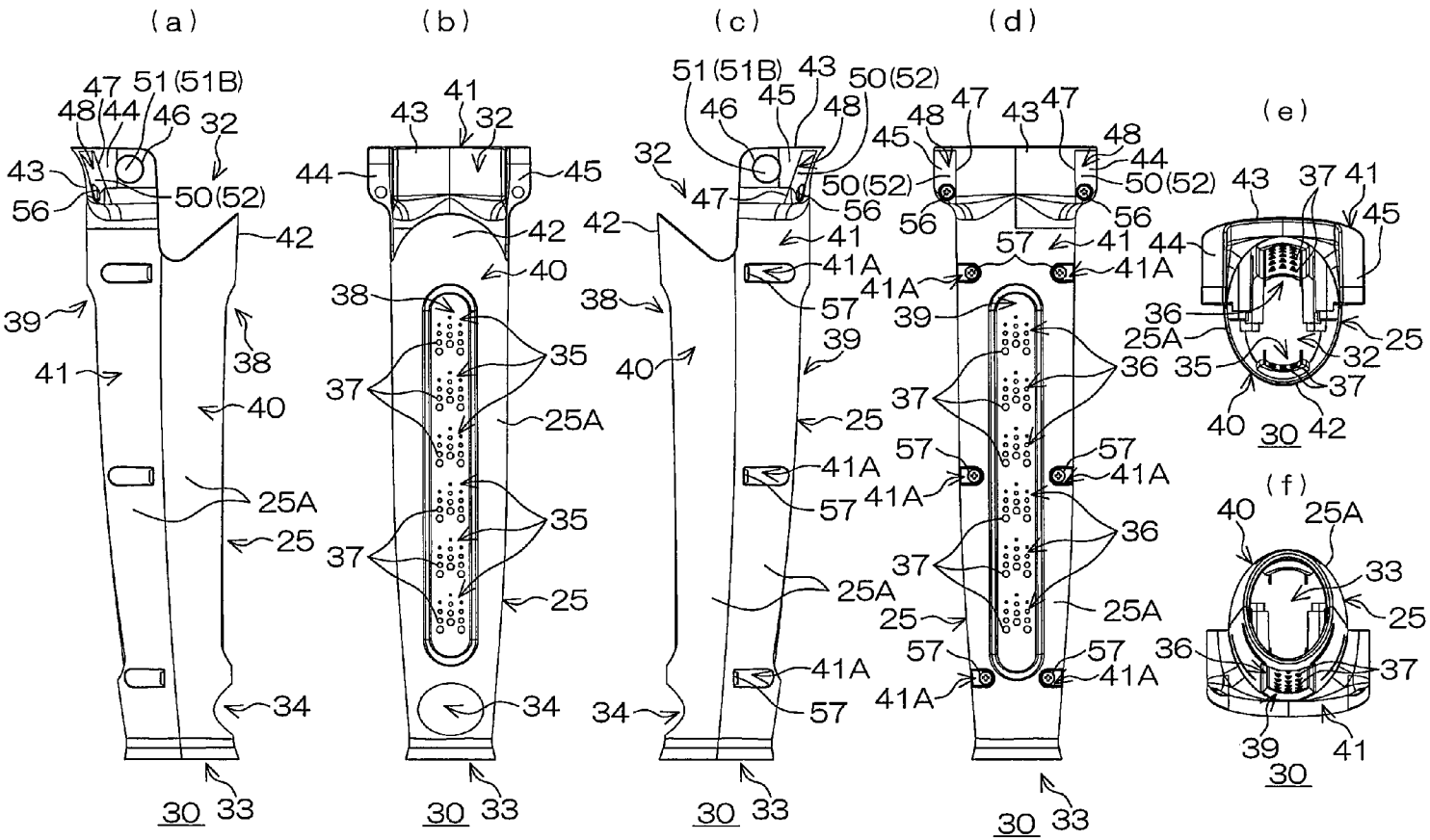
FIG. 5(*a*) is a left side view of the boot attachment 30, FIG. 5(*b*) is a front view of the boot attachment 30, FIG. 5(*c*) is a right side view of the boot attachment 30, FIG. 5(*d*) is a rear view of the boot attachment 30, FIG. 5(*e*) is a plan view of the boot attachment 30, and FIG. 5(*f*) is a bottom view of the boot attachment 30.
Figure 6:
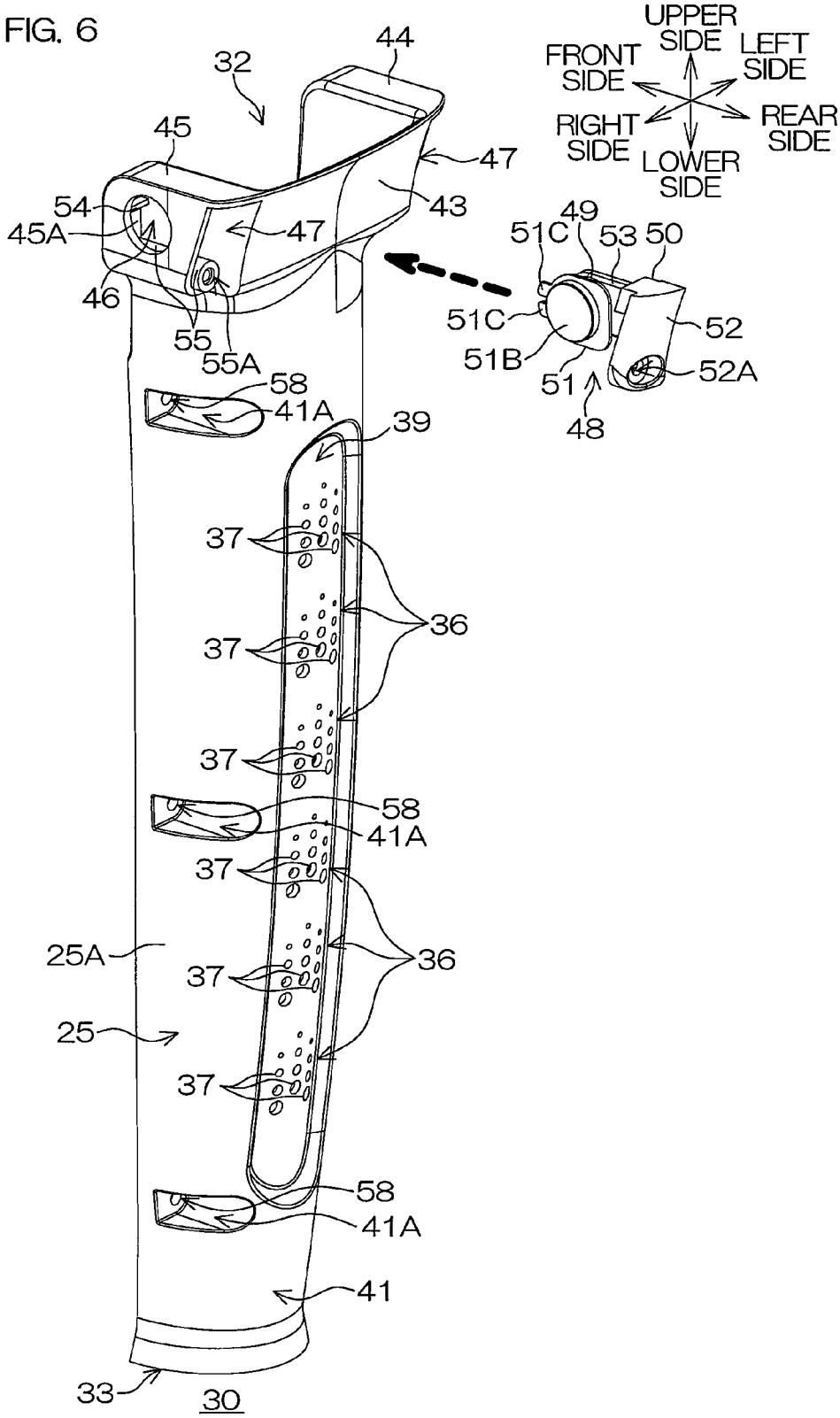
FIG. 6 is a perspective view of the boot attachment 30 as seen from the rear right upper side for explaining how to attach a connection mechanism 48 to a rear part 41 of the boot attachment 30.

FIG. 3 is a perspective view of a boot attachment 30 as seen from the front right upper side. FIG. 4 is a perspective view of a boot tray 31 as seen from the front right upper side. FIG. 5(*a*) is a left side view of the boot attachment 30, FIG. 5(*b*) is a front view of the boot attachment 30, FIG. 5(*c*) is a right side view of the boot attachment 30, FIG. 5(*d*) is a rear view of the boot attachment 30, FIG. 5(*e*) is a plan view of the boot attachment 30, and FIG. 5(*f*) is a bottom view of the boot attachment 30. FIG. 6 is a perspective view of the boot attachment 30 as seen from the rear right upper side for explaining how to attach a connection mechanism 48 to a rear part 41 of the boot attachment 30.

Examples of the laundry to be sanitized by the air-wash operation in the washing machine 1 include shoes and stuffed toys in addition to garments which are generally supposed to be sanitized. Examples of the shoes to be sanitized in the air-wash operation in the washing machine 1 include not only business shoes, sandals and sneakers each having a smaller height but also boots having a greater height.

Boot attachments 30 and a boot tray 31 as shown in FIGS. 3 and 4 are provided as a boot sanitizing aid for sanitizing a pair of boots in the air-wash operation in the washing machine 1. As will be described later, the boot attachments 30 are removably set in the respective boots, and the boot tray 31 is removably set in the drum 8 of the washing machine 1.

(1) Boot Attachments

The boot attachments 30 are provided in pair for the pair of boots. As shown in FIG. 3, the boot attachments 30 each include a tubular member 25, for example, composed of a resin and having a vertically elongated and generally hollow cylindrical shape.

The tubular member 25 is inserted into the boot as will be described later. A middle portion of the tubular member 25 has a size (thickness) such that the tubular member 25 can be inserted into a boot having an ordinary size with a sufficient clearance. The tubular member 25 has a height (vertical size) such that, when the tubular member 25 is inserted in the boot having an ordinary height, an upper end portion of the tubular member 25 is exposed from a boot top.

The thickness of the tubular member 25 progressively decreases in a downward direction, and is slightly greater at its lower end.

The tubular member 25 has an upper opening 32 (introduction port), a first lower vent 33 (vent), a second lower vent 34 (vent, lower vent and lower front vent), a first intermediate vent 35 (vent, intermediate vent) and a second intermediate vent 36 (vent, intermediate vent) (see FIG. 6). The upper opening 32, the first lower vent 33, the second lower vent 34, the first intermediate vent 35 and the second intermediate vent 36 communicate with the inside (hollow portion) of the tubular member 25.

The upper opening 32 is provided in the upper end portion of the tubular member 25 so as to face upward. The first lower vent 33 is provided at the lower end of the tubular member 25 so as to face downward.

The second lower vent 34 is provided in a lower end portion of a front surface of the tubular member 25 (a front portion of an outer surface 25A as a guide portion of the tubular member 25) so as to face forward.

The first intermediate vent 35 is provided in a predetermined vertical portion of the front surface of the tubular member 25 ranging from the upper opening 32 to the second lower opening 34, i.e., a vertically intermediate portion of the tubular member 25, so as to face forward. The first intermediate vent 35 includes a multiplicity of small holes 37 (perforations). A plurality of sets of four small holes 37 are arranged vertically and transversely. In each of the sets, a lower one of the small holes 37 has a greater size than an upper one of the smaller holes 37.

In association with the first intermediate vent 35, a first recess 38 (recess) is provided between the upper opening 32 and the second lower vent 34 in the front surface of the tubular member 25 as being recessed inward of the tubular member 25 (rearward). The first recess 38 is vertically elongated. The first intermediate vent 35 is provided in the first recess 38. That is, the first intermediate vent 35 is provided in the first recess 38 of the front surface (outer surface 25A) of the tubular member 25 that is recessed from the other portion of the front surface.

As shown in FIG. 5(*d*), the second intermediate vent 36 is provided in a vertical portion of a rear surface of the tubular member 25 (in a rear portion of the outer surface 25A of the tubular member 25) corresponding to the portion of the front surface of the tubular member 25 formed with the first intermediate vent 35 (see FIG. 5(*b*)) so as to face rearward. Like the first intermediate vent 35, the second intermediate vent 36 includes a multiplicity of small holes 37.

In association with the second intermediate vent 36, a second recess 39 (recess) is provided in a vertical portion of the rear surface of the tubular member 25 corresponding to the first recess 38 as being recessed inward of the tubular member 25 (forward). Like the first recess 38, the second recess 39 is vertically elongated. The second intermediate vent 36 is provided in the second recess 39. That is, the second intermediate vent 36 is provided in the second recess 39 of the rear surface (outer surface 25A) of the tubular member 25 that is recessed from the other portion of the rear surface.

Referring to FIG. 3, the tubular member 25 is anteroposteriorly dividable into a front part 40 and a rear part 41 along a generally anteroposteriorly middle boundary.

The front part 40 is vertically elongated, and has a generally arcuate shape bulged forward as seen in plan (see FIGS. 5(*e*) and 5(*f*)). The second lower vent 34, the first intermediate vent 35 and the first recess 38 are provided in the front part 40. An upper edge of the front part 40 defines a front half of the upper opening 32, and a lower edge of the front part 40 defines a front half of the first lower vent 33. The upper edge of the front part 40 (more specifically, an upper edge of an upper end portion 42 of the front part 40) has a generally arcuate shape bulged upward as seen from the front side in FIG. 5(*b*), and extends obliquely upward toward the front side as seen transversely (see FIGS. 5(*a*) and 5(*c*)).

As shown in FIG. 6, the rear part 41 is vertically elongated, and has a generally arcuate shape bulged rearward as seen in plan (see FIG. 5(*f*)). The second intermediate vent 36 and the second recess 39 described above are provided in the rear part 41 (see FIG. 5(*d*)). An upper edge of the rear part 41 defines a rear half of the upper opening 32, and a lower edge of the rear part 41 defines a rear half of the first lower vent 33.

As shown in FIGS. 5(*d*) and 6, the rear part 41 has recesses 41A provided in transversely opposite side portions thereof. There are three recesses 41 provided in vertically spaced relation in each of the transversely opposite side portions of the rear part 41, i.e., there are six recesses 41 provided in the transversely opposite side portions of the rear part 41. Through-holes 58 (see FIG. 6) are provided in the respective recesses 41A, and screws 57 extend through the respective through-holes 58 from the rear side, whereby the rear part 41 is combined with the front part 40 (see FIG. 5(*c*)). Thus, the front part 40 and the rear part 41 are unified.

With the front part 40 and the rear part 41 unified as shown in FIG. 3, an upper end portion 43 (introduction portion) of the rear part 41 projects upward as compared with the upper end portion 42 of the front part 40 (see FIGS. 5(*a*), 5(*b*) and 5(*c*)). The upper end portion 43 is thicker than a portion of the rear part 41 present below the upper end portion 43. A rear surface portion of the upper end portion 43 is generally rounded (see FIG. 8). The rear surface of the upper end portion 43 is curved rearward toward the upper side (see FIGS. 5(*a*) and 5(*c*)). The upper end portion 43 has hollow left and right portions 44, 45 which are disposed in transversely opposed spaced relation to each other.

The left and right portions 44, 45 respectively have round holes 46 formed in laterally outer side faces thereof (see FIGS. 5(*a*) and 5(*c*)). The left and right portions 44, 45 further respectively have rectangular holes 47 formed in rear surfaces thereof (see FIGS. 5(*d*) and 6). As shown in FIG. 6, the round hole 46 and the rectangular hole 47 of the right portion 45 communicate with the inside (hollow portion) of the right portion 45. Though not shown, the round hole 46 and the rectangular hole 47 of the left portion 44 communicate with the inside (hollow portion) of the left portion 44.

A rear face 45A of a front wall of the right portion 45 is exposed in the inside of the right portion 45, and a rib 54 is provided on a generally vertically middle portion of the rear face 45A as projecting rearward. A cylindrical boss 55 is provided below the rib 54 on the rear face 45A as projecting rearward toward the rectangular hole 47. A rear end face of the boss 55 is exposed rearward from the rectangular hole 47, and has a screw hole 55A. Though not shown, the left portion 44 also has a rib 54 and a boss 55 provided therein.

Connection mechanisms 48 are respectively fitted in the left and right portions 44, 45.

(2) Connection Mechanisms

Figure 7:
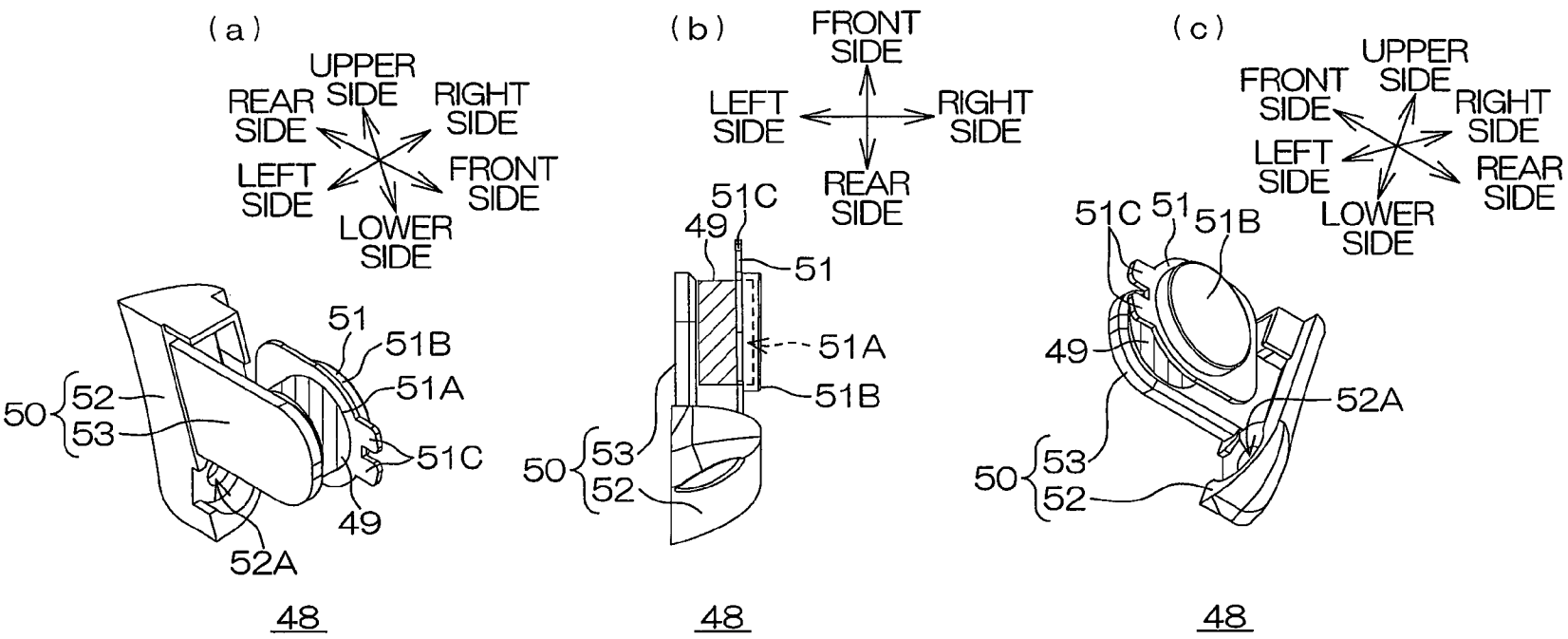
FIG. 7(*a*) is a perspective view of the connection mechanism 48 as seen from the front left upper side, FIG. 7(*b*) is a bottom view of the connection mechanism 48, and FIG. 7(*c*) is a perspective view of the connection mechanism 48 as seen from the front right lower side.
Figure 8:
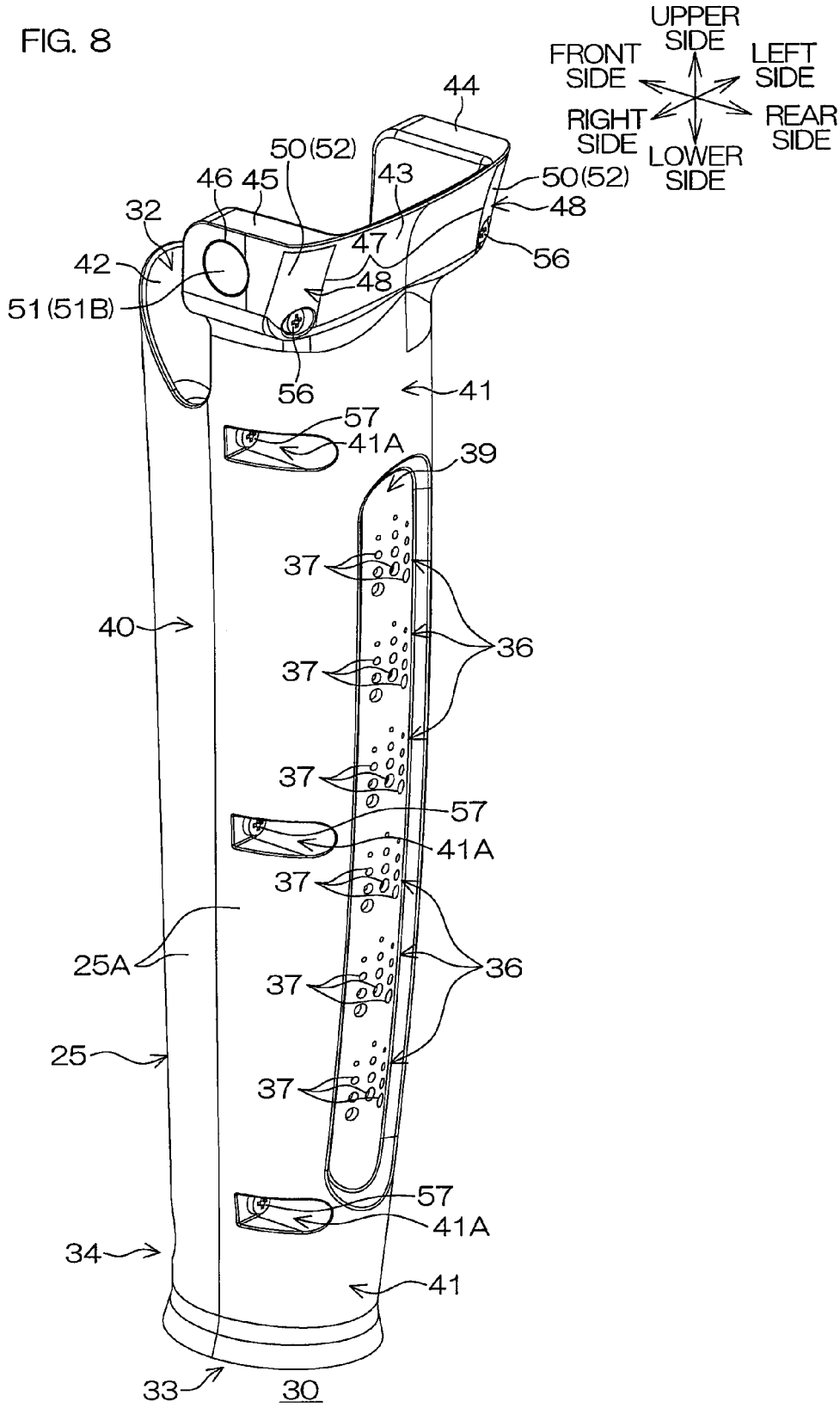
FIG. 8 is a perspective view of the boot attachment 30 as seen from the rear right upper side.

FIG. 7(*a*) is a perspective view of the connection mechanism 48 as seen from the front left upper side, FIG. 7(*b*) is a bottom view of the connection mechanism 48, and FIG. 7(*c*) is a perspective view of the connection mechanism 48 as seen from the front right lower side. FIG. 8 is a perspective view of the boot attachment 30 as seen from the rear right upper side.

Referring to FIGS. 7(*a*) to 7(*c*), two connection mechanisms 48 are provided for the left portion 44 and the right portion 45.

The connection mechanisms 48 each have a size such as to be accommodated in the left portion 44 and the right portion 45. The connection mechanisms 48 each include a magnet 49 serving as a unifying mechanism, a magnet holder 50, and a cap 51.

The magnet 49 has a cylindrical shape, and is disposed with its center axis extending transversely.

The magnet holder 50 has a shape projecting forward as seen transversely (see FIG. 7(*a*)), and unitarily includes a first portion 52 and a second portion 53.

The first portion 52 has a vertically elongated block shape having a size such that the rectangular hole 47 (see FIG. 6) can be properly clogged. The first portion 52 has a through-hole 52A formed in a lower end portion thereof as anteroposteriorly extending therethrough. Like the rear surface of the upper end portion 43, a rear surface portion of the first portion 52 is rounded (see FIGS. 6 and 8).

The second portion 53 is of a plate shape having a smaller thickness as measured transversely, and projects forward from a front surface portion of the first portion 52 above the through-hole 52A. A front end of the second portion 53 is rounded.

The cap 51 has a smaller thickness as measured transversely, and has a generally rectangular plate shape as seen transversely (see FIG. 7(*c*)). The cap 51 has a recess 51A provided in a transversely inner surface (a left side surface in FIG. 7(*b*)) thereof (see FIG. 7(*b*)). The cap 51 has a protuberance 51B provided in a transversely outer surface (a right side surface in FIG. 7(*b*)) thereof as projecting correspondingly to the recess 51A. The protuberance 51B is of a round shape having substantially the same size as the round holes 46 (see FIGS. 5(*a*), 5(*c*) and 6) of the left portion 44 and the right portion 45 of the rear part 41 described above as seen from the transversely outer side. The cap 51 unitarily includes a pair of projections 51C as projecting forward in opposed relation and vertically spaced a small distance from each other (see FIGS. 7(*a*) and 7(*c*)).

A transversely inner end (a left end in FIG. 7(*b*)) of the magnet 49 is undetachably fixed to a front portion of a transversely outer surface (a right surface in FIG. 7(*b*)) of the second portion 53 of the magnet holder 50, and a transversely outer end (a right end in FIG. 7(*b*)) of the magnet 49 is embedded in the recess 51A of the cap 51 (see FIG. 7(*b*)). Thus, the magnet 49, the magnet holder 50 and the cap 51 of the connection mechanism 48 are unified.

Next, a procedure for accommodating and fixing the connection mechanism 48 in the right portion 45 of the rear part 41 will be described with reference to FIG. 6. A procedure for accommodating and fixing the connection mechanism 48 in the left portion 44 is the same as the procedure for accommodating and fixing the connection mechanism 48 in the right portion 45.

First, the connection mechanism 48 is held behind the rectangular hole 47 of the right portion 45 with the front end (projections 51C) of the cap 51 located at a front end of the connection mechanism 48 and with the protuberance 51B of the cap 51 located at a transversely outer portion (a left portion in FIG. 6) of the connection mechanism 48. In turn, the connection mechanism 48 is moved forward (as indicated by an arrow of a broken line in FIG. 6) to be inserted into the right portion 45 through the rectangular hole 47. When a rear edge of the rib 54 abuts against a front edge of the cap 51 between the pair of projections 51C with the rib 54 inside the right portion 45 being held between the pair of projections 51C of the cap 51, the connection mechanism 48 is stopped and accommodated in the right portion 45 (see FIG. 8).

With the connection mechanism 48 being accommodated in the right portion 45, as shown in FIG. 8, the protuberance 51B of the cap 51 is fitted in the round hole 46 of the right portion 45 with no gap, and exposed from the round hole 46 on the transversely outer side. The first portion 52 of the magnet holder 50 clogs the rectangular hole 47 (see FIG. 6) from the rear side with no gap. In this state, a rear surface of the first portion 52 is smoothly continuous to a portion of the rear surface of the right portion 45 around the rectangular hole 47. Further, the through-hole 52A of the first portion 52 is anteroposteriorly opposed to the screw hole 55A of a rear end face of the boss 55 exposed from the rectangular hole 47 on the rear side (see FIG. 6). Therefore, the first portion 52 is connected to the boss 55 by screwing the screw 56 in the screw hole 55A through the through-hole 52A. That is, the connection mechanism 48 is accommodated in the right portion 45 and, in this state, fixed to the right portion 45 (rear part 41). The caps 51 of the left and right connection mechanisms 48 may be unified with the left portion 44 and the right portion 45 (i.e., the rear part 41). In this case, no round holes 46 are formed in the left portion 44 and the right portion 45.

(3) Boot Tray

As shown in FIG. 4, the boot tray 31 is a generally rectangular tray shape as seen in plan. That is, the boot tray 31 unitarily includes a bottom wall 60 having a generally rectangular plate shape as seen in plan, and a frame wall 61 extending upward from an outer periphery of the bottom wall 60 to surround an upper face of the bottom wall 60 from anteroposterior and lateral sides. The boot tray 31 has a recess 62 provided in a transversely middle portion of a rear edge portion of the frame wall 61 thereof as being recessed forward. The bottom wall 60 has a protrusion 63 protruding upward and extending from a generally middle portion thereof to the recess 62 as seen in plan. The protrusion 63 has a width and a protruding height that are progressively increased in a direction toward the recess 62 (i.e., toward the rear side). The upper surface of the bottom wall 60 is transversely divided into a left region 60A and a right region 60B by the protrusion 63. The bottom wall 60 has a recess 60C (receiving portion) provided in a lower portion thereof as being recessed upward correspondingly to the protrusion 63.

(4) Boot Air-Wash Operation

Figure 9:
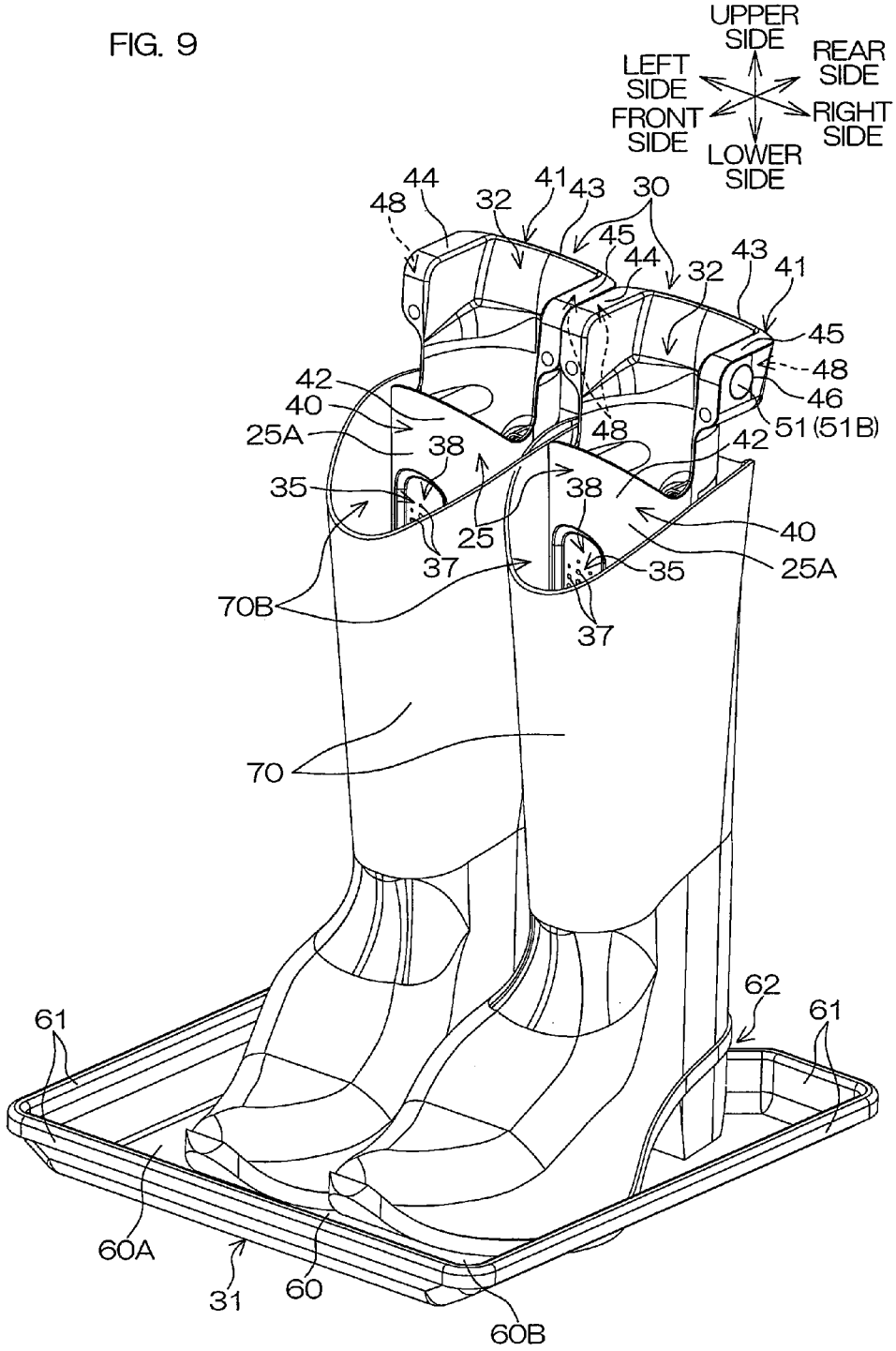
FIG. 9 is a perspective view of a pair of boots 70 placed on the boot tray 31 with boot attachments 30 respectively inserted in the boots 70 as seen from the front right upper side.
Figure 10:
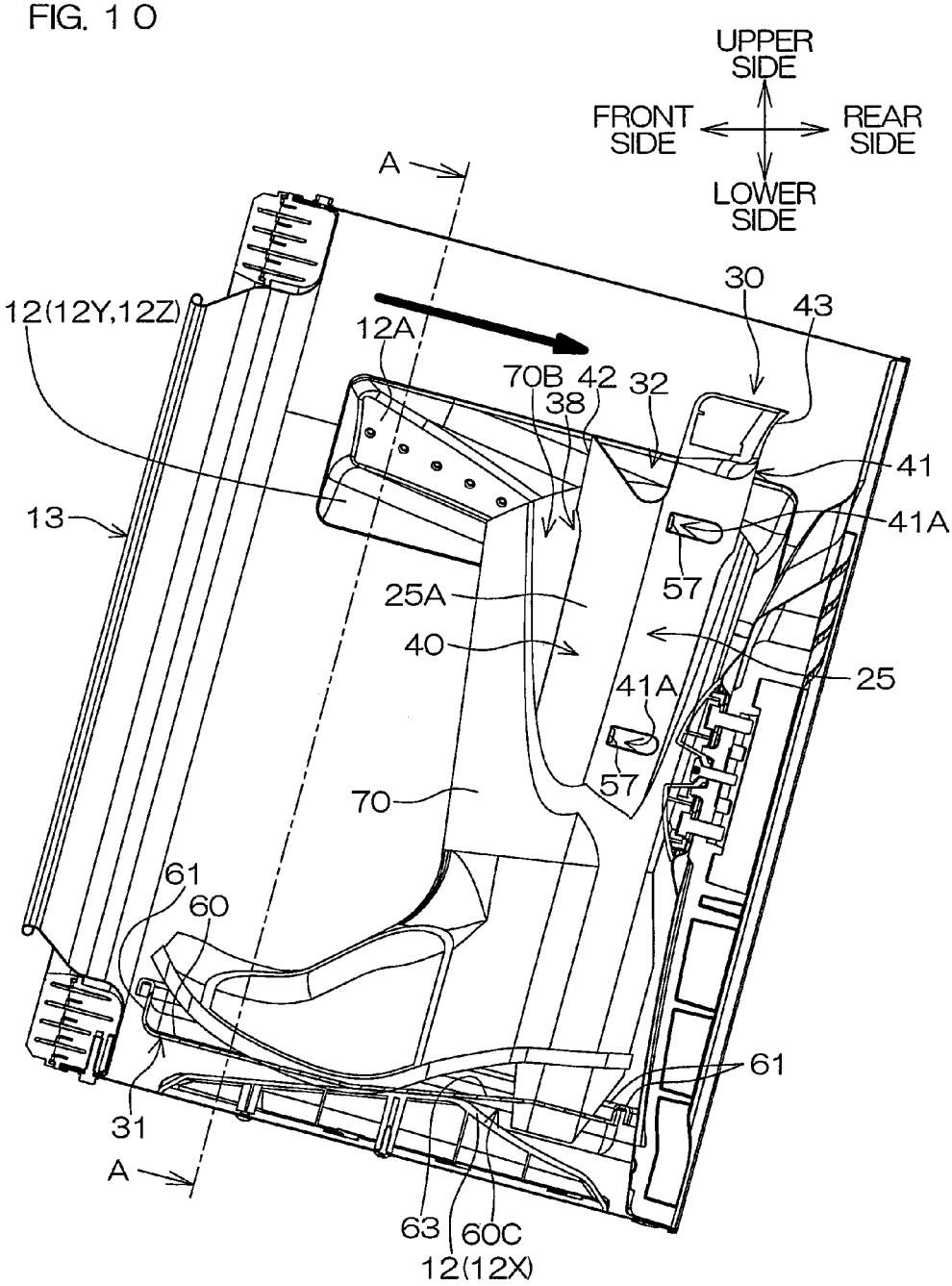
FIG. 10 is a right side sectional view of a drum 8 which retains the pair of boots 70 placed on the boot tray 31 with the boot attachments 30 respectively inserted in the boots 70.
Figure 11:
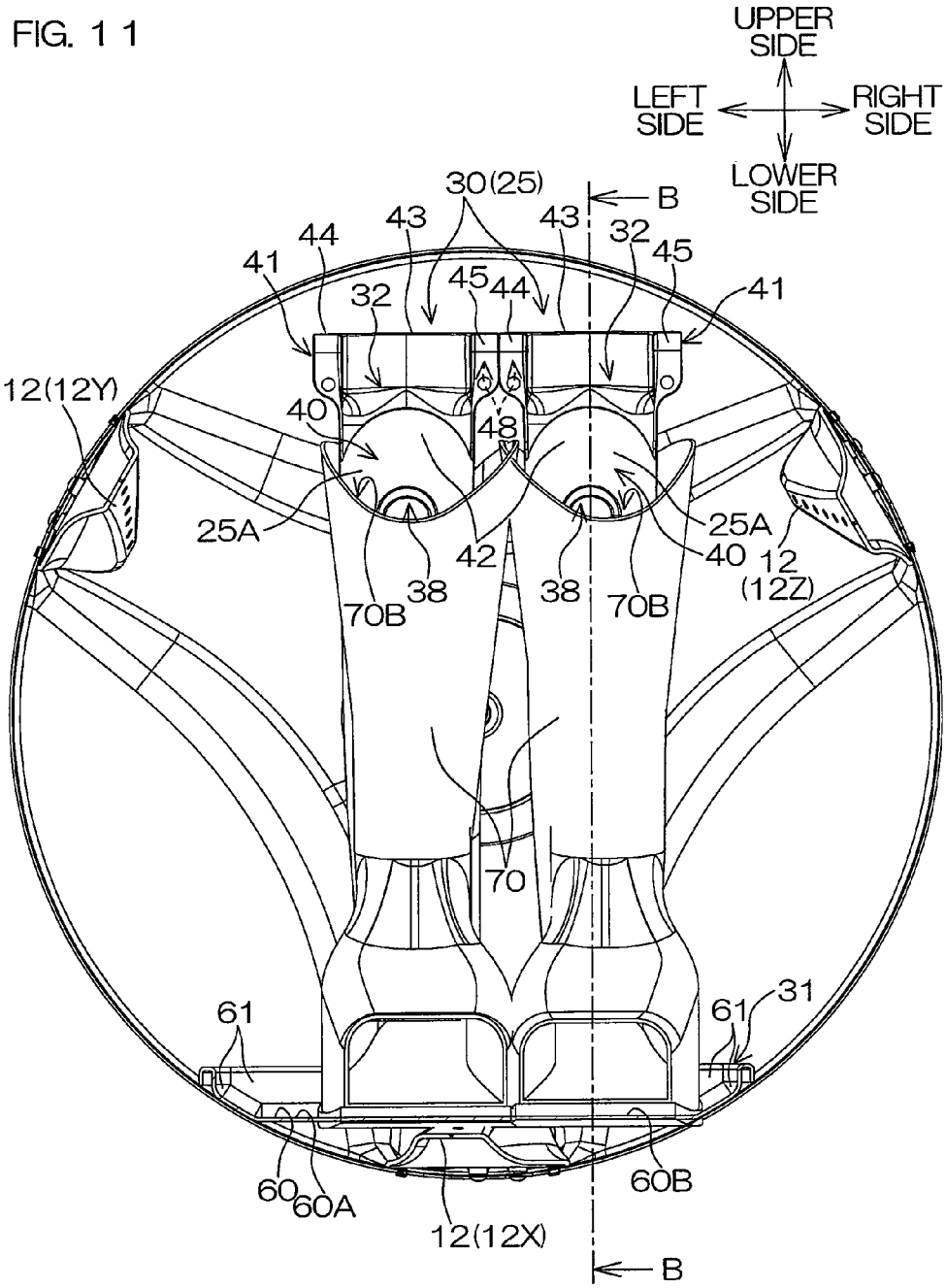
FIG. 11 is a sectional view as seen in a direction indicated by arrows A-A in FIG. 10.
Figure 12:
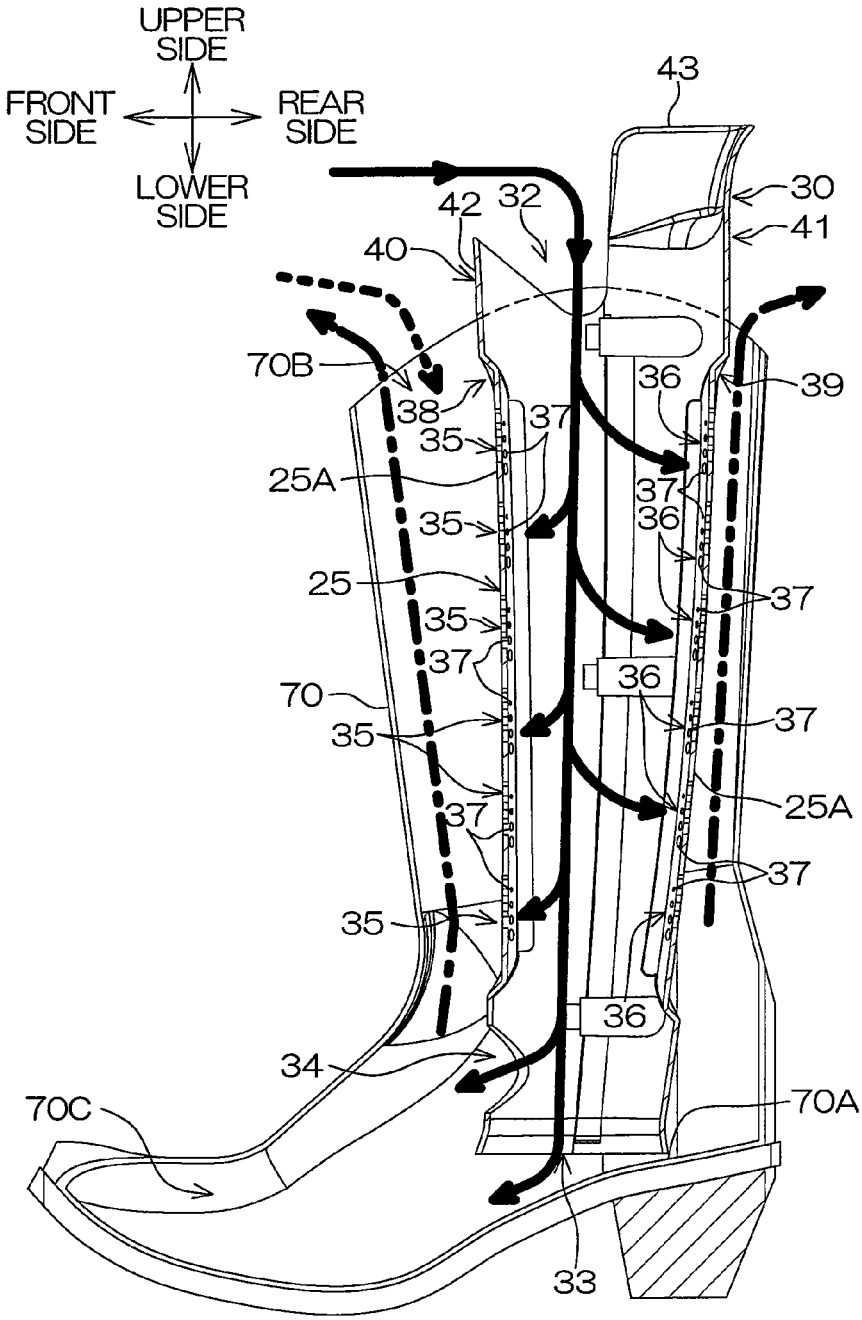
FIG. 12 is a sectional view as seen in a direction indicated by arrows B-B in FIG. 11.

FIG. 9 is a perspective view of a pair of boots 70 placed on the boot tray 31 with the boot attachments 30 respectively inserted in the boots as seen from the front right upper side. FIG. 10 is a right side sectional view of the drum 8 which retains the pair of boots 70 placed on the boot tray 31 with the boot attachments 30 respectively inserted in the boots. FIG. 11 is a sectional view as seen in a direction indicated by arrows A-A in FIG. 10. FIG. 12 is a sectional view as seen in a direction indicated by arrows B-B in FIG. 11.

Next, a boot air-wash operation will be described.

As shown in FIG. 9, the pair of boots 70 are first placed on the upper surface of the bottom wall 60 of the boot tray 31. At this time, the left boot 70 as seen from the front side is placed on the left region 60A of the upper surface of the bottom wall 60, and the right boot 70 as seen from the front side is placed on the right region 60B of the upper surface of the bottom wall 60. One of the paired boot attachments 30 (more specifically, the tubular members 25) is inserted into the left boot 70, and the other boot attachment 30 is inserted into the right boot 70. The boot attachments 30 can each be used for either of the right and left boots 70.

In this state, as shown in FIG. 12, the tubular member 25 is inserted in each of the boots 70 with a sufficient clearance. That is, the outer surface 25A of the tubular member 25 (more specifically, a portion of the tubular member 25 below the upper end portion) is opposed to and spaced a predetermined distance from an inner peripheral surface of the boot 70 (more specifically, an inner peripheral surface portion of the boot 70 above a heel portion 70A).

The tubular member 25 is kept upright in the boot 70 with the lower end thereof in abutment against the heel portion 70A in the boot 70. The upper end portion of the tubular member 25 (the upper end portion 42 of the front part 40 and the upper end portion 43 of the rear part 41) is exposed from a top 70B of the boot 70 to the upper side. Here, the upper end portion 42 of the front part 40 is located forward of the upper end portion 43 of the rear part 41.

With the tubular member 25 inserted in the boot 70, the first lower vent 33 is opposed to the heel portion 70A from the upper side in the boot 70, and the second lower vent 34 is directed toward a toe portion 70C in the boot 70. The first intermediate vent 35 faces toward a front portion of the inner peripheral surface of the boot 70, while the second intermediate vent 36 faces toward a rear portion of the inner peripheral surface of the boot 70.

With the tubular members 25 of the boot attachments 30 inserted in the right and left boots 70, as shown in FIG. 9, a right connection mechanism 48 of the boot attachment 30 inserted in the left boot 70 as seen from the front side and a left connection mechanism 48 of the boot attachment 30 inserted in the right boot 70 as seen from the front side are located transversely adjacent each other. Here, the connection mechanisms 48 each include the magnet 49 (see FIGS. 7(*a*) to 7(*c*)). Therefore, the right connection mechanism 48 of the left boot attachment 30 and the left connection mechanism 48 of the right boot attachment 30 are attracted to each other by the magnetic forces of the magnets 49. Thus, the paired right and left boot attachments 30 are unified. The right and left boot attachments 30 thus unified are supported by each other, whereby the tubular members 25 of the boot attachments 30 stably stand upright in the respective boots 70 (see FIG. 12).

Then, the boot tray 31 on which the boots 70 are placed with the boot attachments 30 (tubular members 25) respectively inserted therein is retained (set) in the drum 8 of the washing machine 1 as shown in FIG. 10. Prior to the setting of the boot tray 31 in the drum 8, as shown in FIG. 11, the drum 8 is manually moved to locate one of the three baffles 12 at a lowermost position. As described above, the three baffles 12 are circumferentially equidistantly arranged on the inner peripheral surface of the drum 8. With the one baffle 12 located at the lowermost position, therefore, the other baffles 12Y, 12Z are not vertically opposed to the lowermost baffle 12X on the inner peripheral surface of the drum 8.

Then, the boot tray 31 is set in the drum 8 as straddling the lowermost baffle 12X from the above. At this time, as shown in FIG. 10, the rear end 12B (see FIG. 1) of the lowermost baffle 12X is fitted in the recess 60C of the boot tray 31 to be received in the recess 60C. Thus, the boot tray 31 is properly positioned in the drum 8. With the one baffle 12X located at the lowermost position, as described above, the baffles 12Y, 12Z are not vertically opposed to the lowermost baffle 12X on the inner peripheral surface of the drum 8 (see FIG. 11). That is, the other baffles 12Y, 12Z are located away from the boots 70 placed on the boot tray 31 and the upper edges of the boot attachments 30 in the drum 8. This prevents the other baffles 12Y, 12Z from interfering with the boots 70 and the boot attachments 30, thereby stabilizing the postures of the boots 70 and the boot attachments 30 in the drum 8.

After the boot tray 31 on which the boots 70 are placed with the boot attachments 30 inserted therein is set in the drum 8, the door 5 (see FIG. 1) is closed, and the air-wash operation is performed. In this case, the control section 18 (see FIG. 2) does not rotate the drum 8, because the boot attachments 30, the boot tray 31 and the boots 70 are scattered in the drum 8 by the rotation of the drum 8.

The boot air-wash operation is performed for a longer period (e.g., 60 minutes) than the ordinary air-wash operation for garments. As shown in FIG. 1, more specifically, the ozone-containing air (cleaning air) flowing to the space between the upper edge of the opening 4 and the upper edge of the port 13 from the air flow passage 16 hits against the conical surface 5A of the door 5 to be introduced into the port 13 and fed into the drum 8 through the port 13 (see the bold arrow in FIG. 1).

Referring to FIG. 10, the cleaning air fed into the drum 8 flows rearward in the drum 8 (see a bold arrow in FIG. 10). Then, the cleaning air hits from the front side against the upper end portions of the tubular members 25 of the boot attachments 30 (the upper end portions 42 of the front parts 40 and the upper end portions 43 of the rear parts 41) projecting upward from the tops 70B of the boots 70.

As indicated by a bold dotted line arrow in FIG. 12, the cleaning air hitting against the upper end portions 42 of the front parts 40 is deflected downward toward the tops 70B of the boots 70. Then, the cleaning air flows through the tops 70B, and down through the spaces between the tubular members 25 and the front sides of the inner peripheral surfaces of the boots 70 by its own weight, thus spreading in the boots 70.

As indicated by arrows of bold solid lines in FIG. 12, the cleaning air hitting against the upper end portions 43 of the rear parts 41 is deflected downward toward the upper opening 32. Then, the cleaning air is introduced into the tubular members 25 through the upper openings 32 to be fed (taken) into the tubular members 25, and flows down through the tubular members 25 by its own weight. Thus, the upper end portions 43 serve to introduce the cleaning air into the tubular members 25. Then, the cleaning air flowing down through the tubular members 25 partly flows out of the tubular members 25 through the small holes 37 of the first intermediate vents 35 and the second intermediate vents 36 to the front and rear sides of the tubular members 25 (i.e., to the spaces between the tubular members 25 and the inner peripheral surfaces of the boots 70). The cleaning air flowing down through the tubular members 25 to the first lower vents 33 flows out of the tubular members 25 through the first lower vents 33 to reach the heel portions 70A in the boots 70. The cleaning air flowing down through the tubular members 25 to the second lower vents 34 flows out of the tubular members 25 through the second lower vents 34, and further flows toward the toes (toe portions 70C) in the boots 70. Thus, the cleaning air from the tubular members 25 spreads in the boots 70.

After the cleaning air spreading in the boots 70 serves to sanitize the insides of the boots 70, the cleaning air flows upward through the spaces between the tubular members 25 and the inner peripheral surfaces of the boots 70 toward the tops 70B of the boots 70 to flow out of the boots 70 through the boot tops 70B as indicated by arrows of bold one-dot-and-dash lines. At this time, the outer surfaces 25A of the tubular members 25 guide the upward flow of the cleaning air. The outer surfaces 25A of the tubular members 25 may be formed with ribs or grooves for guiding the upward flow of the cleaning air.

As described above, the cleaning air fed into the drum 8 is smoothly introduced into the tubular members 25 of the boot attachments 30 by the upper end portions 43 to flow down through the tubular members 25 (see the arrows of the bold solid lines). Then, the cleaning air flows out of the tubular members 25 through the first intermediate vents 35, the second intermediate vents 36, the first lower vents 33 and the second lower vents 34 to spread inside the boots 70 (see the arrows of the bold solid lines). Thus, the insides of the boots 70 are sanitized with the cleaning air.

The air flowing out of the tubular members 25 and used for the sanitization of the insides of the boots 70 (air containing almost no ozone due to decomposition of the ozone after the sanitization of the insides of the boots 70) is lighter in weight than the ozone (the cleaning air initially flowing into the tubular members 25 from the upper openings 32), and is guided upward by the outer surfaces 25A of the tubular members 25 to flow through the spaces between the tubular members 25 and the inner peripheral surfaces of the boots 70 toward the tops 70B of the boots 70. Thus, the cleaning air smoothly flows out of the boots 70 (see the arrows of the bold one-dot-and-dash lines). This facilitates the flow of the cleaning air in the boots 70, so that fresh cleaning air can be smoothly introduced into the tubular members 25.

As shown in FIG. 9, the paired boot attachments 30 inserted in the respective boots 70 are unified by means of the magnets 49 of the connection mechanisms 48 provided in the upper portions of the tubular members 25 (see FIGS. 7(*a*) to 7(*c*) and 8), so that the boot attachments 30 can be supported by each other. This stabilizes the postures of the boot attachments 30 during the sanitization of the insides of the boots 70. As described above, the stabilization of the postures of the boots 70 and the boot attachments 30 is also achieved by preventing the baffles 12Y, 12Z from interfering with the boots 70 and the boot attachments 30 with the use of the boot tray 31 (see FIG. 11). Therefore, the cleaning air can be effectively applied to the boots 70 in the drum 8.

As a result, the boots 70 can be advantageously sanitized with the cleaning air by using the boot attachments 30 and the boot tray 31 in the washing machine 1.

Particularly, as shown in FIG. 12, the cleaning air flowing out of the tubular members 25 through the second lower vents 34 further flows toward the toe portions 70C in the boots 70, whereby the toe portions 70C can be advantageously sanitized with the cleaning air.

The cleaning air flowing out of the tubular members 25 through the first intermediate vents 35 and the second intermediate vents 36 is directed toward inside portions of the boots 70 corresponding to portions of the tubular members 25 ranging from the upper portions to the lower portions (antero-posteriorly and laterally of the boot attachments 30), whereby the inside portions of the boots 70 can be advantageously sanitized with the cleaning air. Since the first intermediate vents 35 and the second intermediate vents 36 each include the multiplicity of small holes 37 provided in predetermined vertical ranges of the tubular members 25, the cleaning air can smoothly flow out of the tubular members 25 through the small holes 37.

The first intermediate vents 35 and the second intermediate vents 36 (i.e., the small holes) are respectively provided in the first recesses 38 and the second recesses 39 formed in the outer surfaces 25A of the tubular members 25 as being recessed inward of the tubular members 25. This prevents the first intermediate vents 35 and the second intermediate vents 36 from being closed by the interior surfaces of the boots 70 even if the interior surfaces of the boots 70 contact the outer surfaces 25A of the tubular members 25. Therefore, the cleaning air can smoothly flow out of the tubular members 25 through the first intermediate vents 35 and the second intermediate vents 36.

Since the control section 18 (see FIG. 2) performs the air-wash operation to supply the cleaning air into the drum 8 for the predetermined period, the boots 70 can be advantageously sanitized.

The present invention is not limited to the embodiment described above, but various modifications may be made within the scope of the claims.

For example, an arrangement for the air wash of the boots 70 may be provided as an apparatus independent of the washing machine 1. That is, an arrangement including only the drum 8, the blower 15, the air flow passage 16 and the ozone generator 17 provided in the washing machine 1 (see FIG. 1) may be provided as a boot storage apparatus mainly adapted to sanitize the boots 70. Of course, the boot attachments 30 and the boot tray 31 (see FIGS. 3 and 4) are used in the boot storage apparatus as in the washing machine 1 described above.

The boot attachments 30 may be used as a shoe keeper to be respectively inserted into the boots 70 when the air-wash operation is not performed. This prevents the boots 70 from losing their shapes.

In the embodiment described above, the boot tray 31 is set in the drum 8 (see FIGS. 10 and 11) after the boots 70 are placed on the boot tray 31 (see FIG. 9). Alternatively, only the boot tray 31 may be first set in the drum 8, and then the boots 70 in which the boot attachments 30 are respectively inserted may be placed on the boot tray 31 in the drum 8.

If the boots 70 each have a smaller height, the upper edges of the boots 70 and the boot attachments 30 do not interfere with the baffles 12Y, 12Z described above (see FIG. 11). Therefore, there is no need to move the baffle 12× to the lowermost position as described above.

If it is possible to stably set the boots 70 in the drum 8 without the boot tray 31, there is no need to use the boot tray 31 to perform the air-wash operation.

In the embodiment described above, the pair of boots 70 is sanitized in the air-wash operation, but only one of the boots 70 may be sanitized.

What is claimed is:

1. A washing machine comprising:

a wash water tub;

a drum provided in the wash water tub rotatably about a rotation axis extending in a horizontal direction or inclined at a predetermined angle with respect to the horizontal direction, the drum having a port provided in one of opposite end faces thereof with respect to a rotation axis extending direction, the drum being capable of containing laundry loaded therein through the port;

three baffles circumferentially equidistantly provided on an inner peripheral surface of the drum for agitating the laundry in the drum;

cleaning air supply means which supplies cleaning air into the drum through the port for sanitizing the laundry;

a boot tray having a baffle receiving portion which receives one of the baffles located at a lowermost position, the boot tray being set in the drum so as to straddle the one baffle for receiving a pair of boots placed thereon; and a pair of boot attachments to be inserted into the respective boots;

wherein the paired boot attachments each include:

a tubular member to be inserted into the boot with a sufficient clearance for causing the cleaning air supplied into the drum to flow down therethrough from an upper portion thereof;

an introduction portion provided in the upper portion of the tubular member so as to be exposed from a boot top for introducing the cleaning air supplied to the drum into the tubular member;

a lower vent provided in a lower portion of the tubular member so as to be directed toward a toe portion in the boot for causing the cleaning air to flow out of the tubular member;

an intermediate vent provided in a vertically intermediate portion of the tubular member for causing the cleaning air to flow out of the tubular member;

a guide portion which guides the air flowing out of the tubular member and, after sanitization of inside of the boot, causes the air to flow up through a space between the tubular member and an interior surface of the boot toward the boot top; and a unifying mechanism provided in the upper portion of the tubular member for unifying the paired boot attachments.

2. The washing machine according to claim 1, further comprising control means which performs a sanitizing operation to sanitize the boots by causing the cleaning air supply means to supply the cleaning air into the drum for a predetermined period.

3. A washing machine comprising:

a wash water tub;

a drum provided in the wash water tub rotatably about a rotation axis extending in a predetermined direction for containing laundry therein;

cleaning air supply means which supplies cleaning air into the drum for sanitizing the laundry;

a boot tray to be set in the drum for receiving a pair of boots placed thereon;

and a pair of boot attachments to be inserted into the respective boots; wherein the paired boot attachments each include:

a tubular member through which the cleaning air supplied into the drum flows down from an upper portion thereof; and a vent through which the cleaning air flows out of the tubular member;

wherein the boot tray unitarily includes a bottom wall, and a frame wall extending upward from an outer periphery of the bottom wall to surround an upper face of the bottom wall from anteroposterior and lateral sides, and wherein the boot tray has a recess provided in a transversely middle portion of a rear edge portion of the frame wall thereof, being recessed forward, and wherein the bottom wall has a protrusion protruding upward and extending from a middle portion thereof to the recess, the protrusion having a width and a protruding height that progressively increase in a direction toward the recess.

4. The washing machine according to claim 3, wherein the vent includes a lower vent provided in a lower portion of the tubular member so as to be directed toward a toe portion in the boot.

5. The washing machine according to claim 3, wherein the vent includes an intermediate vent provided in a vertically intermediate portion of the tubular member.

6. The washing machine according to claim 5, wherein the intermediate vent includes a multiplicity of small holes provided in a predetermined vertical range of the tubular member.

7. The washing machine according to claim 6, wherein the tubular member has a recess provided in an outer surface thereof as being recessed inward thereof, and the intermediate vent is provided in the recess.

8. A boot sanitizing aid to be retained in a drum of a drum type washing machine for sanitizing a boot, the boot sanitizing aid comprising:

a boot tray to be set in the drum for receiving a boot placed thereon; and a boot attachment including a tubular member to be inserted into the boot placed on the boot tray, the tubular member having an introduction port provided at an upper end thereof for introducing cleaning air supplied to the drum into the tubular member, a lower front vent provided in a lower portion thereof for causing the cleaning air introduced into the tubular member to flow toward a toe portion in the boot, and a multiplicity of perforations provided in a side wall thereof for causing the cleaning air introduced into the tubular member to laterally flow out of the tubular member, wherein the boot tray unitarily includes a bottom wall, and a frame wall extending upward from an outer periphery of the bottom wall to surround an upper face of the bottom wall from anteroposterior and lateral sides, and wherein the boot tray has a recess provided in a transversely middle portion of a rear edge portion of the frame wall thereof, being recessed forward, and wherein the bottom wall has a protrusion protruding upward and extending from a middle portion thereof to the recess, the protrusion having a width and a protruding height that progressively increase in a direction toward the recess.

9. A boot tray to be removably set in a washing machine including a rotatable drum having three baffles circumferentially equidistantly provided on an inner peripheral surface thereof for agitating laundry in the drum, and cleaning air supply means which supplies cleaning air into the drum for sanitizing the laundry, the boot tray having a baffle receiving portion which receives one of the baffles located at a lowermost position, the boot tray being set in the drum so as to straddle the one baffle for receiving a boot placed thereon, wherein the boot tray unitarily includes a bottom wall, and a frame wall extending upward from an outer periphery of the bottom wall to surround an upper face of the bottom wall from anteroposterior and lateral sides, and wherein the boot tray has a recess provided in a transversely middle portion of a rear edge portion of the frame wall thereof, being recessed forward, and wherein the bottom wall has a protrusion protruding upward and extending from a middle portion thereof to the recess, the protrusion having a width and a protruding height that progressively increase in a direction toward the recess.

10. A boot attachment to be used with a boot storage apparatus including a boot container which contains a boot, and cleaning air supply means which supplies cleaning air into the boot container for sanitizing the boot, the boot attachment comprising:

a tubular member having an upper portion and a lower portion with a first intermediate portion and a second intermediate portion therebetween, the tubular member being configured to be inserted into the boot for causing the cleaning air supplied into the boot container to flow down therethrough from an upper portion thereof, the tubular member having an outer wall extending from the upper portion to the lower portion, at least one inward recess being formed in the first intermediate portion of the outer wall, the at least one inward recess being vertically elongated, the second intermediate portion of the outer wall not being recessed; and a vent through which the cleaning air flows out of the tubular member provided in the at least one inward recess.

11. The boot attachment according to claim 10, further comprising:

an introduction portion provided in an upper portion of the tubular member so as to be exposed from a boot top for introducing the cleaning air supplied to the boot container into the tubular member; and a unifying mechanism provided in the upper portion of the tubular member for unifying a pair of such boot attachments;

wherein the vent includes a lower vent provided in a lower portion of the tubular member so as to be directed toward a toe portion in the boot.

12. The boot attachment according to claim 10, further comprising:

an introduction portion provided in an upper portion of the tubular member so as to be exposed from a boot top for introducing the cleaning air supplied to the boot container into the tubular member; and a unifying mechanism provided in the upper portion of the tubular member for unifying a pair of such boot attachments.

* * * * *